US006207102B1

(12) United States Patent
Rohlin et al.

(10) Patent No.: US 6,207,102 B1
(45) Date of Patent: Mar. 27, 2001

(54) METHOD OF SINTERING CEMENTED CARBIDE BODIES

(75) Inventors: Barbro Rohlin, Djursholm; Margareta Pålsson, Gimo, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/214,622

(22) PCT Filed: Jun. 23, 1997

(86) PCT No.: PCT/SE97/01117

§ 371 Date: Aug. 10, 1999

§ 102(e) Date: Aug. 10, 1999

(87) PCT Pub. No.: WO98/02395

PCT Pub. Date: Jan. 22, 1998

(30) Foreign Application Priority Data

Jul. 11, 1996 (SE) ..... 9602751
Dec. 20, 1996 (SE) ..... 9604777

(51) Int. Cl.[7] ..... C04B 33/32
(52) U.S. Cl. ..... 264/643; 427/255
(58) Field of Search ..... 264/643, 642; 427/255

(56) References Cited

U.S. PATENT DOCUMENTS 4,282,289 8/1981 Kullander et al. ..... 428/457
4,401,297 8/1983 Doi et al. ..... 266/252
4,911,989 3/1990 Minoru et al. ..... 428/547
5,380,408 1/1995 Svensson ..... 204/129.1
5,681,651 * 10/1997 Yoshimura et al. ..... 428/216

FOREIGN PATENT DOCUMENTS 88-053269 3/1988 (JP) .
88-060279 3/1988 (JP) .
88-060280 3/1988 (JP) .

OTHER PUBLICATIONS

Patent Abstracts of Japan, vol. 14, No. 473, M–1035, abstract of JP,A,21–90403 (Mitsubishi Metal Corp), Jul. 26, 1990.
Patent Abstracts of Japan, vol. 9, No. 260, C–309, abstract of JP,A, 60–110838 (Sumitomo Denki Kogyo KK), Jun. 17, 1985.
Patent Abstracts of Japan, abstract of JP,A,63011631, publ. Jan. 19, 1988, Derwents Abstract, Accession No. 88–054404 & JP,A,63011631.

* cited by examiner

*Primary Examiner*—Christopher A. Fiorilla
(74) *Attorney, Agent, or Firm*—Burns, Doane, Swecker & Mathis, L.L.P.

(57) ABSTRACT

A method of sintering cemented carbide bodies includes heating said bodies to the sintering temperature in a suitable atmosphere and cooling. If said cooling at least to below 1250° C. is performed in a higher speed i.e. at more than 20° C./min cemented carbide bodies with no surface layer of binder phase are obtained. This is an advantage when said bodies are to be coated with wear resistant layers by the use of CVD-, MTCVD- or PVD-technique.

4 Claims, 2 Drawing Sheets

METHOD OF SINTERING CEMENTED CARBIDE BODIES

This application is a 371 of PCT/SE97/01117 filed Jul. 7, 1997.

BACKGROUND OF THE INVENTION

The present invention relates to a sintering method for cemented carbide for the purpose of eliminating the binder phase layer from its surface before applying coatings on said surface.

Coated cemented carbide inserts have now for many years been commercially available for chip forming machining of metals in the metal cutting industry. Such inserts are commonly made of a metal carbide, normally WC, generally with the addition of carbides of other metals such as Nb, Ti, Ta, etc. and a metallic binder phase of cobalt. By depositing onto said inserts a thin layer of a wear resistant material such as TiC, TiN, $Al_2O_3$ etc., separately or in combination, it has been possible to increase the wear resistance toughness essentially maintained.

During sintering cemented carbide inserts often obtain a completely or partly covering binder phase layer generally <1 $\mu$m thick on their surface. This particularly applies to inserts with a binder phase enrichment in the surface below the coating, so called cobalt gradient, but also to inserts with an even distribution of binder phase. In the latter case, this layer forms on certain grades but not on others. The reason for this is not understood at present. However, the layer has a negative effect on the process when carrying out CVD- or PVD-deposition, which results in layers with inferior properties and insufficient adherence. The binder phase layer must therefore be removed before carrying out the deposition process.

It is possible to remove such a binder phase layer mechanically by blasting. The blasting method is, however, difficult to control. The difficulty resides in the inability to control consistently the blasting depth with the necessary accuracy, which leads to an increased scatter in the properties of the final product—the coated insert. It also results in damages to the hard constituent grain of the surface. However, in Swedish patent application 9202142-7 it is disclosed that blasting with fine particles gives an even removal of the binder phase layer without damaging the hard constituent grains.

Chemical or electrolytic methods could be used as alternatives for mechanical methods. U.S. Pat. No. 4,282,289 discloses a method of etching in a gaseous phase by using HCl in an initial phase of the coating process. In EP-A-337 696 there is proposed a wet chemical method of etching in nitric acid, hydrochloric acid, hydrofluoric acid, sulphuric acid and similar or electro-chemical methods. From JP 88-060279 it is known to use an alkaline solution, NaOH, and from JP 88-060280 to use an acid solution. JP 88-053269 discloses etching in nitric acid prior to diamond deposition. There is one drawback with these methods, namely, that they are incapable of only removing the cobalt layer. They also result in deep penetration, particularly in areas close to the edge. The etching medium not only removes cobalt from the surface but also penetrates areas between the hard constituent grains. As a result, an undesired porosity between layer and substrate is obtained at the same time as the cobalt layer may partly remain in other areas of the insert. U.S. Pat. No. 5,380,408 discloses an etching method according to which electrolytic etching is performed in a mixture of sulphuric acid and phosphoric acid. This method gives an even and complete removal of the binder phase layer without depth effect, i.e. reaching zero Co-content on the surface.

On the other hand it is in some cases not desirable to reach a zero Co-content on the surface from a coating adhesive point of view, but rather a Co surface content close to nominal content.

The above mentioned methods require additional production steps and are for that reason less attractive for production in a large scale. It would be desirable if sintering could be performed in such a way that no binder phase layer is formed or alternatively can be removed during cooling.

OBJECTS AND SUMMARY OF THE INVENTION

It is an object of this invention to avoid or alleviate the problems of the prior art.

It is therefore an object of the present invention to provide a method of sintering cemented carbide in such a way that no binder phase layer is present on the surface after the sintering process but a well defined Co content.

It is an aspect of this invention to provide a method of making coated cemented carbide bodies with a composition of 4 to 15 weight % Co, upt to 20 weight % cubic carbides and rest WC said method including the steps of sintering cemented carbide bodies including heating to a sintering temperature above 1350° C. in an argon atmosphere, cooling the bodies in the temperature range from 1350° to 1250° C. at a cooling rate of more than 20° C./min and providing the bodies with a thin wear resistant coating including at least one layer by CVD-, MTCVD- or PVD-technique.

DETAILED DESCRIPTION OF THE PREFERRED EMBODIMENTS OF THE INVENTION

According to the method of the present invention the heating and high temperature steps of the sintering are performed in the conventional way. However, cooling from sintering temperature is speeded up from normally about 40 minutes from 1450 to below 1250° C. to less than 10 min, preferably less than 5 min, through the same temperature range, i.e., a cooling rate of more than 20, preferably more than 40° C./min. Preferably, said cooling rate is maintained during the solidification period, i.e. between 1350 and 1250° C. The cooling should however not exceed 100° C./min. This is made possible by a specially designed furnace. The best conditions depend on the design of the equipment used, on the composition of the cemented carbide and on the sintering conditions. It is within the purview of the skilled artisan to determine by experiments the optimum cooling speed for which no binder phase layer is obtained. The sintering should lead to a Co content on the surface of +6/−4%, preferably +4/−2%. The Co content can be determined e.g. by the use of a SEM (Scanning Electron Microscope) equipped with an EDS (Energy Dispersive Spectrometer) and comparing the intensities of Co from the unknown surface and a reference, e.g. a polished section of the same nominal composition.

The method of the invention can be applied to all kinds of cemented carbides, preferably to cemented carbide with a composition of 4 to 15 weight-% Co, up to 20 weight-% cubic carbides such as TiC, TaC, NbC etc. and rest WC. Most preferably the cemented carbide has a composition 5 to 12 weight-% Co, less than 12 weight-% cubic carbides such as TiC, TaC, NbC etc. and rest WC. The average WC grain size shall be <8 $\mu$m, preferably 0.5–5 $\mu$m.

Inserts according to the invention are after sintering provided with a thin wear resistant coating including at least one layer by CVD-, MTCVD- or PVD-technique as known in the art.

The invention is additionally illustrated in connection with the following Examples which are to be considered as illustrative of the present invention. It should be understood, however, that the invention is not limited to the specific details of the Examples.

EXAMPLE 1

Figure 1:
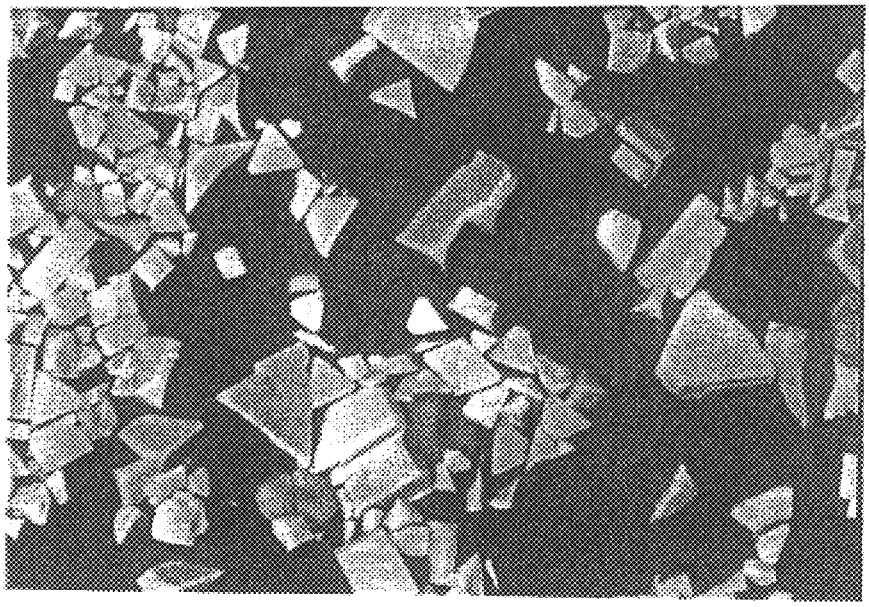
FIGS. 1 and 3 show in 4000× magnification a top view of the surface of cemented carbide inserts partly covered with a binder phase layer.

Cemented carbide inserts of type CNMG 120408 with 5.5 weight-% Co, 8.5 weight-% cubic carbides and 86 weight-% WC of 2 $\mu$m average WC-grain size were sintered in a conventional way at 1450° C. and cooled to room temperature in argon. The surface was up to 50% covered with a Co-layer, FIG. 1.

Figure 2:
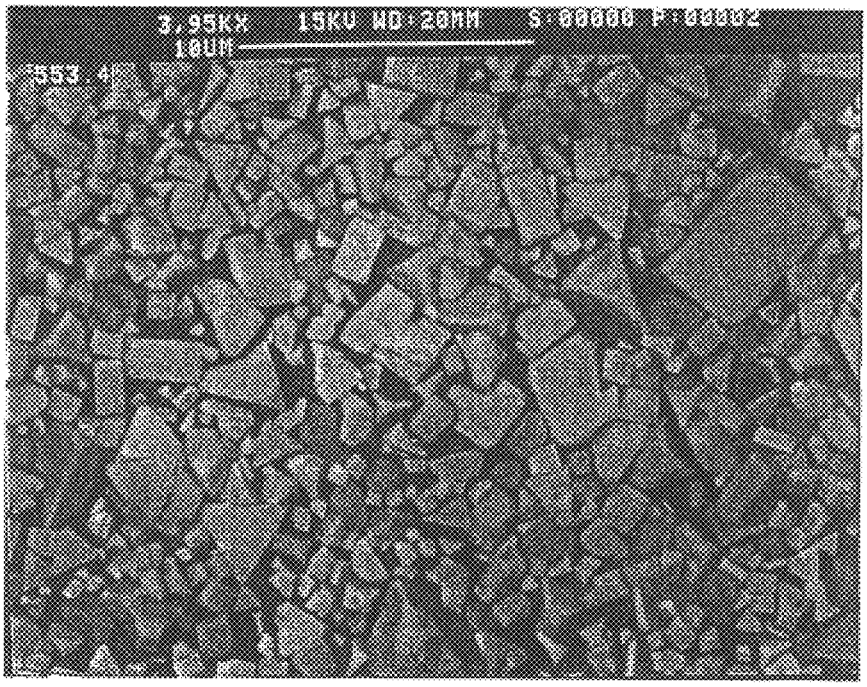
FIGS. 2 and 4 show in 4000× magnification a top view of the surface of a cemented carbide insert sintered according to the invention. In these figures the dark grey areas are the Co-layer, the light grey angular grains are WC and the grey rounded grains are the so called gamma phase which is (Ti,Ta,Nb,W)C.

Inserts of the same composition and type were sintered in the same way but cooled from 1450 to 1250° C. temperature within 5 minutes. The surface was to about 6% covered with Co, which corresponds to the nominal Co content, FIG. 2.

EXAMPLE 2

Figure 3:
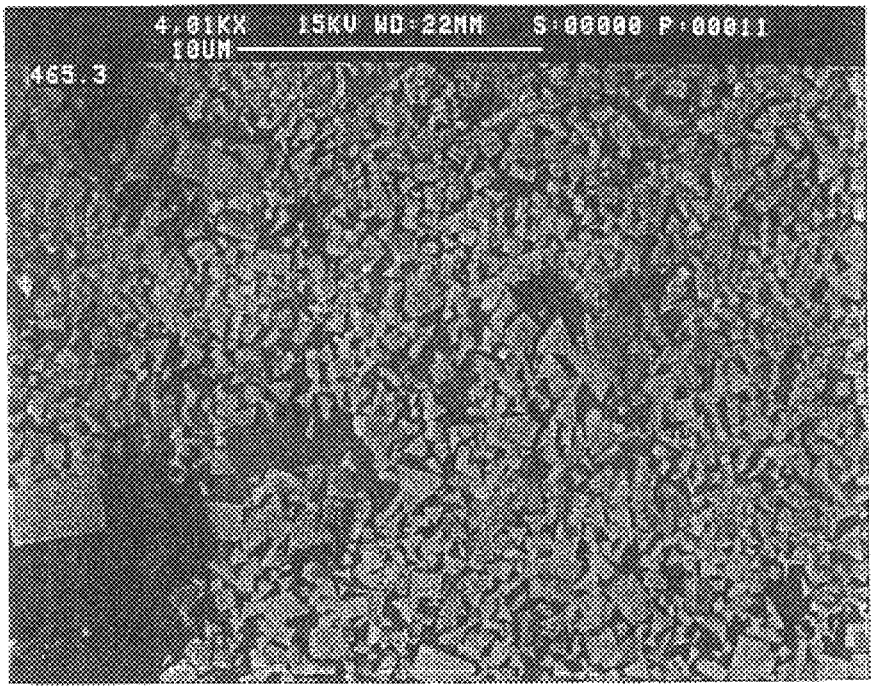

Cemented carbide inserts of type CNMG 120408 with 10 weight-% Co and 90 weight-% WC of 0.9 $\mu$m average WC-grain size were sintered in a conventional way at 1410° C. and cooled to room temperature in argon. The surface was up to 50% covered with a Co-layer, FIG. 3.

Figure 4:
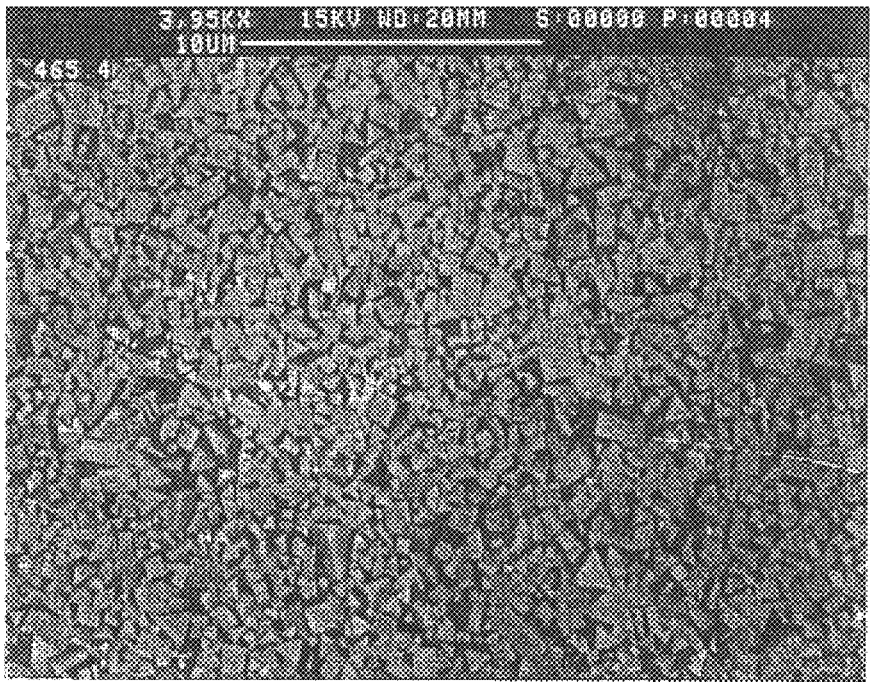

Inserts of the same composition and type were sintered in the same way but cooled from 1350 to 1250° C. temperature within 2.5 minutes. The surface was to about 10% covered with cobalt, which corresponds to the nominal Co content, FIG. 4.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making coated cemented carbide bodies with a composition of 4 to 15 weight % Co, up to 20 weight % cubic carbides and rest WC said method including the steps of:

sintering cemented carbide bodies including heating to a sintering temperature above 1350° C. in an argon atmosphere;

cooling the bodies in the temperature range from 1350° to 1250° C. at a cooling rate of more than 20° C./min to form binder phase of nominal content on the surface;

cooling the bodies thereafter in a conventional manner; and providing the bodies with a thin wear resistant coating including at least one layer by CVD-, MTCVD- or PVD-technique.

2. The method of claim 1 wherein the cemented carbide bodies are sintered at a temperature up to about 1450° C.

3. The method of claim 2 wherein the sintered cemented carbide bodies are cooled from the sintering temperature to 1250° C. at a cooling rate of more than 20° C./min.

4. The method of claim 1 wherein the sintered cemented carbide bodies are cooled in the temperature range at a cooling rate of more than 40° C./min.

* * * * *